US006648629B2

(12) United States Patent
Ichikawa et al.

(10) Patent No.: US 6,648,629 B2
(45) Date of Patent: Nov. 18, 2003

(54) IGNITING OPERATION MECHANISM OF PIEZOELECTRIC IGNITION LIGHTER

(75) Inventors: Toshihiro Ichikawa, Sunto-gun (JP); Naoto Adachi, Sunto-gun (JP)

(73) Assignee: Tokai Corporation, Tokyo (JP)

( * ) Notice: Subject to any disclaimer, the term of this patent is extended or adjusted under 35 U.S.C. 154(b) by 0 days.

(21) Appl. No.: 10/048,741

(22) PCT Filed: May 30, 2001

(86) PCT No.: PCT/JP01/04530

§ 371 (c)(1),
(2), (4) Date: Apr. 29, 2002

(87) PCT Pub. No.: WO01/94849

PCT Pub. Date: Dec. 13, 2001

(65) Prior Publication Data

US 2002/0136996 A1 Sep. 26, 2002

(30) Foreign Application Priority Data

Jun. 2, 2000 (JP) ..... 2000-165440

(51) Int. Cl.[7] ..... F23D 11/26; F23Q 7/12
(52) U.S. Cl. ..... 431/153; 431/255
(58) Field of Search ..... 431/153, 255

(56) References Cited

U.S. PATENT DOCUMENTS 3,883,289 A * 5/1975 Fujioka ..... 431/131
5,854,530 A * 12/1998 LaForest et al. ..... 310/339
5,927,962 A * 7/1999 Amoros Nollas et al. .. 431/255
5,971,751 A 10/1999 Lee
6,045,354 A * 4/2000 McDonough et al. ..... 431/153
6,046,528 A * 4/2000 LaForest et al. ..... 310/339

FOREIGN PATENT DOCUMENTS

JP 3-66986 3/1991
JP U3066986 12/1999

* cited by examiner

*Primary Examiner*—Alfred Basichas
(74) *Attorney, Agent, or Firm*—Dellett and Walters

(57) ABSTRACT

The present invention intends to provides a piezoelectric ignition lighter capable of avoiding misuse by children but maintaining excellent operability for normal users without unreasonably increasing actuation load at the initial ignition operation. For this end, the piezoelectric ignition lighter has a valve mechanism, a nozzle 3 and a piezoelectric mechanism 4 at the top of a lighter body 1 and ignites by actuation of an actuation cap 6 integrally molded of polyacetal resin with torsion plates 7,7. The torsion plates 7,7 are separated from the upper end surface 1*a* of the lighter body 1 by a gap equal to about 60%~90% of the actuation stroke in the non-actuated condition to provide a normal (light) actuation load at the initial actuation stage. After engagement of the torsion plates 7,7 with the upper end surface of the lighter body 1, resilient load of the torsion plates is added to normal load, thereby increasing the actuation load.

3 Claims, 5 Drawing Sheets

FIG. 4
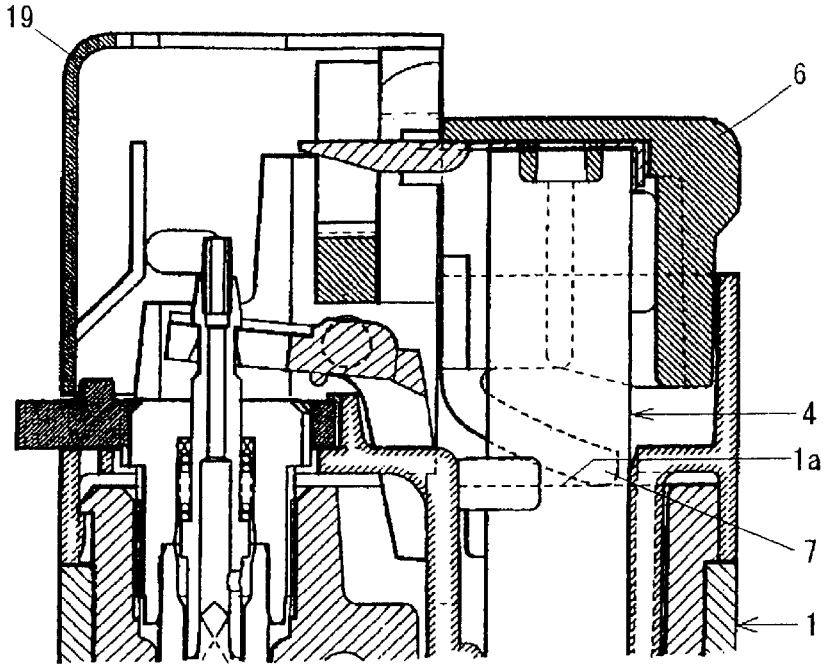
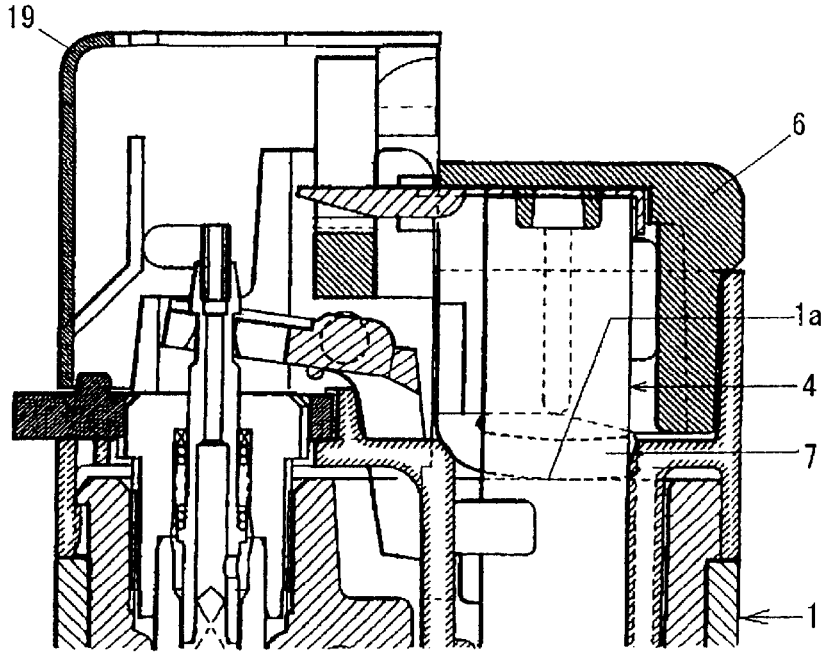
FIG. 5

IGNITING OPERATION MECHANISM OF PIEZOELECTRIC IGNITION LIGHTER

FIELD OF INVENTION

The present invention relates generally to a piezoelectric ignition lighter, more specifically to an ignition mechanism for a piezoelectric ignition lighter with enhanced safety by increasing actuation load (a load to resist actuation).

BACKGROUND OF INVENTION

Piezoelectric ignition lighters are very convenient because they can ignite by simple actuation or pushing-down of their actuation members. Unfortunately, they are not preferable in terms of safety because they can carelessly ignite by children or other persons who lack in knowledge about their proper use.

One solution to avoid careless or inadvertent ignition of such lighters by persons who have no knowledge of proper use is to increase actuation load as disclosed, for example, in U.S. Pat. No. 5,971,751. That is, a coil spring and a resilient member are disposed inside the actuation button to provide resilient loads of the coil spring and the resilient member to the normal actuation load of the piezoelectric mechanism. In this manner, the ignition actuation mechanism increases actuation load before the piezoelectric mechanism reaching compressed discharge. Also commercially available are lighters having larger than normal spring load inside piezoelectric mechanisms to disable ignition by any person having no knowledge of their proper use.

However, such conventional ignition actuation mechanisms of piezoelectric ignition lighters for improving safety by increasing actuation load are inconvenient to all users. Because the actuation load is heavy over the entire actuation stroke of ignition operation of the piezoelectric mechanism and provides very heavy load from the initial stage of the ignition operation.

It is, therefore, an object of the present invention to provide an ignition actuation mechanism for piezoelectric ignition lighter that avoids unreasonably heavy load at the initial stage of ignition operation but increases the actuation load immediately before discharge. In this arrangement, the present invention effectively avoids misuse of the lighter by any person who lack knowledge about proper use of the lighter while maintaining excellent operation to all normal users.

DISCLOSURE OF THE INVENTION

The ignition actuation mechanism for piezoelectric ignition lighter according to the present invention is a type having a piezoelectric mechanism for generating discharge voltage that causes spark between discharge electrodes to ignite fuel gas by actuation of the actuation member in a single direction. It features in the load (actuation load) resisting operation of the actuation member being sharply increased in the way of actuation stroke for generating discharge voltage by depressing the piezoelectric mechanism. In this manner, the load is light at the initial stage of the ignition operation but becomes heavy at the final stage, thereby avoiding misuse by any person having poor knowledge of proper use but maintaining excellent operability for normal users.

The piezoelectric ignition lighter may have a vertically movable actuation cap assembled, for example, at the top of the piezoelectric mechanism. It is also possible to apply the present invention to a slidable actuation cap that actuates the piezoelectric mechanism by way of a lever or the like.

Preferably, the actuation load is sharply increased at 40%~10% of the entire actuation stroke before generating the discharge voltage. Operability is poor if the timing to increase the actuation load is too early. On the other hand, children may be able to actuate the igniter if the timing is too late.

Preferably, the maximum actuation load is 30N~50N. It is preferable that the actuation load is as high as possible in order to increase safety. However, too heavy actuation load leads to poor operability.

Concrete constructions to increase actuation load of the piezoelectric mechanism in the way of the actuation stroke include, for example, disposing a resilient member between the actuation member and the lighter body to be resiliently compressed in the way of the actuation stroke. A spring load of the piezoelectric mechanism acts as resistance to the actuation member at the initial stage of actuation stroke of the piezoelectric unit and the resilient load of the resilient member is added to the spring load of the piezoelectric mechanism in the way of the actuation stroke.

The resilient member may be a torsion plate that is an integral part of the actuation member.

The necessary torsion plate is made from durable material to resist repeated usage. Such durable torsion plate may be made from polyacetal resin integrally molded with the actuation member. It is also possible to separate the resilient member from the actuation member. The resilient member may be made from a metal spring.

BRIEF DESCRIPTION OF DRAWINGS

FIG. 4 is a longitudinal cross-section view of the compression ignition lighter according to the present invention with the top portion in a lighter load initial ignition stage;

FIG. 5 is a longitudinal cross-section view of the compression ignition lighter according to the present invention with the top portion in a heavy load final ignition stage.

PREFERRED EMBODIMENTS OF THE INVENTION

Now, an embodiment of the present invention will be described in detail by reference to accompanying drawings.

Figure 1:
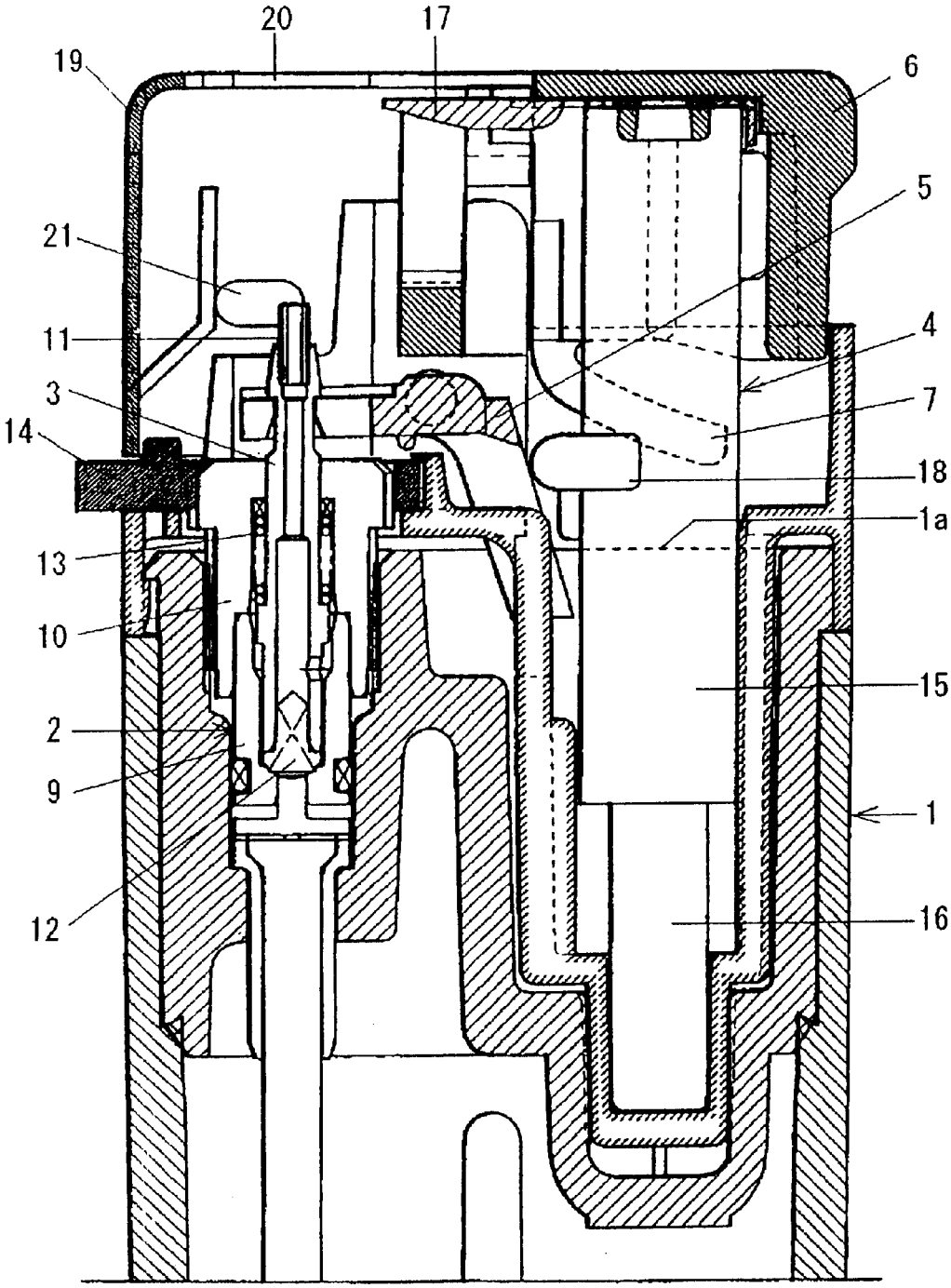
FIG. 1 is a cross-section view of the compression ignition lighter of one embodiment of the present invention with the non-actuated top portion.

As illustrated in FIG. 1, the piezoelectric ignition lighter comprises a valve mechanism 2 to open and close a gas path at the top of a lighter body 1 containing fuel gas for controlling the amount of fuel gas, a nozzle 3 for emitting the fuel gas from the valve mechanism 2, a piezoelectric mechanism 4 for generating discharge voltage, a gas lever 5 for opening the valve mechanism 3 in ganged with the piezoelectric mechanism 4 to emit fuel gas from the nozzle 3 and an actuation cap 6 for actuating the piezoelectric mechanism 4 and actuating the gas lever 5 by way of a lever pusher 18 that is described hereinafter and acts as one electrode of the piezoelectric mechanism 4.

Figure 2:
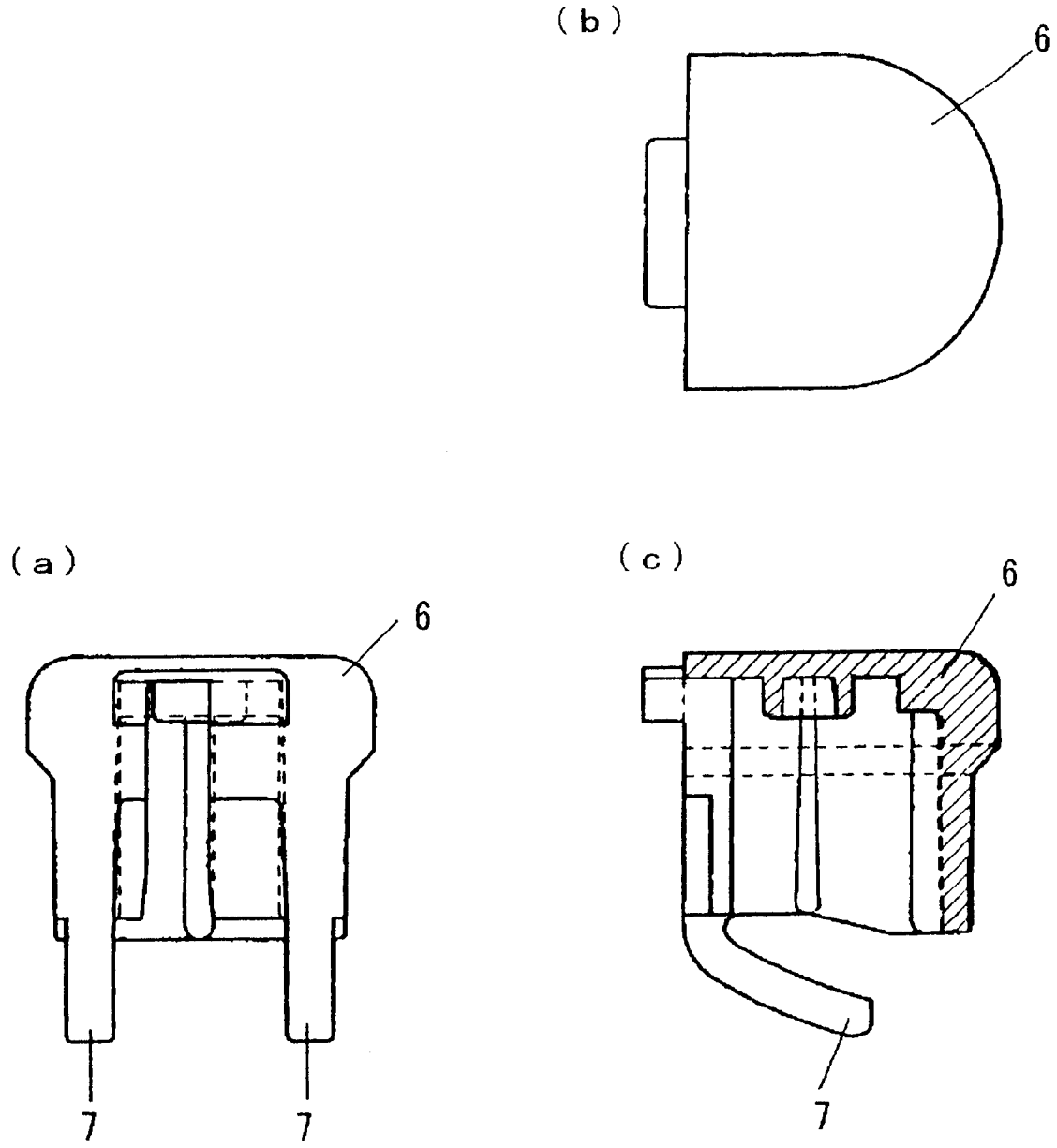
FIG. 2 shows a front view (a), a plan view (b) and a longitudinal cross-section view (c) of the actuation cap of the compression ignition lighter according to the present invention.

The actuation cap 6 is made by molding polyacetal resin and is an integral member of a cap body including a generally semi-oval actuation portion and a sliding portion extending below the actuation portion and a pair of torsion plates 7,7 as shown in FIG. 2. The pair of torsion plates 7,7 are formed at both right and left sides of the bottom of the cap body 6 and are curved at their lower portions.

The valve mechanism 2 is a conventional design and is provided with a nozzle screw 10 at the upper portion nozzle bottom 9 constituting a gas path and a valve seat. The nozzle 3 is disposed passing through the nozzle screw 10 in a movable manner in the axial direction. Installed at the front end of the nozzle 3 is a nozzle tip 11. The lower portion of the nozzle 3 reaches the valve seat of the nozzle bottom 9 and a valve rubber 12 is installed at the end of the lower portion.

The nozzle 3 is biased towards the valve seat by a nozzle spring 13 disposed inside the nozzle screw 10. The valve rubber 12 is seated on the valve seat of the valve bottom 9 to close the gas path. The gas path opens by raising the nozzle 3. The valve mechanism 2 is constructed to adjust the amount of fuel gas emission by rotating an adjusting ring 14 to rotate the nozzle screw 10.

Also, the piezoelectric mechanism 4 is a conventional design and comprises an outer case 15 containing a piezoelectric element for generating high voltage pulse when shock is applied. Inserted into the outer case 15 is an inner case 16 containing a hammer for applying shock onto the piezoelectric element. The inner case 16 is constructed to be movable in an axial direction between an initial engaged position where the hammer is separated from the piezoelectric element and a position where the hammer hits the piezoelectric element. Also disposed in the outer case 15 is a return spring for biasing the outer case 15 with respect to the inner case 16 in such manner that the gap between the piezoelectric element and the hammer is increased. Disposed in the inner case 16 is a hammer spring for biasing the hammer towards the piezoelectric element.

Figure 3:
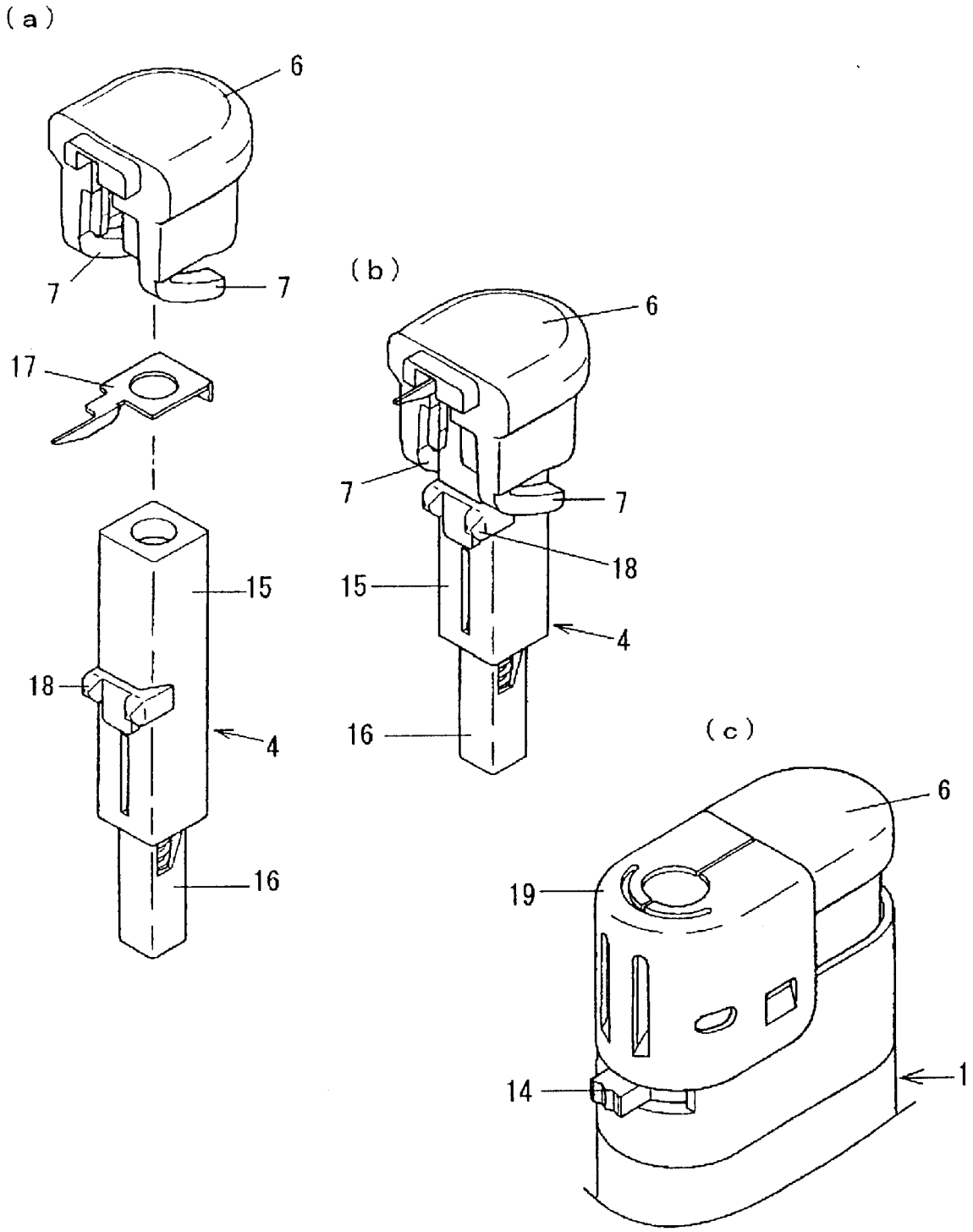
FIG. 3 shows an exploded perspective view of the actuation cap (a), an assembled perspective view of the actuation cap (b) and a perspective view of the assembled top portion with the actuation cap assembly (c) of the compression ignition lighter according to the present invention.

As illustrated in FIGS. 3(*a*) and (*b*), attached on the upper portion of the outer case 15 of the piezoelectric mechanism 4 is the actuation cap 6 in engagement with the discharge terminal 17. The actuation cap 6 is installed in the lighter body 1 as an actuation cap assembly. Illustrated in FIG. 3(*c*) is an upper portion of the assembled lighter. The outer case 15 is attached to the lever pusher 18 that rotates in such manner to raise the nozzle 3 and pushes the gas lever 5 when the outer case 15 is depressed by way of the actuation cap 6. The gas lever 5 is generally L-shape in cross-section and is formed with a nozzle engagement portion at one end to engage with a neck portion at the tip of the nozzle 3. The center portion is pivotally supported at the upper portion of the lighter body 1. A leg portion at the other end is disposed to extend downwardly at an angle to abut against the lever pusher 18 at the side facing the outer case 15 of the piezoelectric mechanism 4. When the outer case 15 is depressed by way of the actuation cap 6, the gas lever 5 is pushed down and caused to rotate by the lever pusher 18. This causes the nozzle 3 to move upwardly to open the valve mechanism 2 and to allow the nozzle 3 to emit fuel gas.

After installation of the actuation cap assembly, a cap 19 is installed on the upper portion of the lighter body 1 to cover the ignition space. The cap 19 is formed with a flame opening 20 in alignment with the axis of the nozzle 3 and also air windows 21 at locations in the top and side portions.

The upper portion of the assembled lighter is illustrated in FIG. 3(*c*). A portion of the cap 19 is overlapped with forward upper portion of the actuation cap 6, thereby restricting the upper limit position of the actuation cap 6.

The torsion plates 7,7 integral with the actuation cap 6 are formed in such dimension to provide a predetermined gap (e.g., 3.4 mm) with the upper end surface 1*a* of the lighter body 1 in the non-actuated condition as illustrated in FIG. 1. The gap is set to about 60%~90% of the actuation stroke (e.g., 4.5 mm) of the actuation cap 6.

The piezoelectric ignition lighter ignites by depressing the actuation cap 6. That is, by depressing the actuation cap 6, the outer case 15 of the piezoelectric mechanism 4 is pushed down and the gas lever 5 rotates by being pushed by the lever pusher 18. As a result, the nozzle 3 is raised to open the valve 2 for emitting fuel gas from the nozzle 3. When the actuation cap 6 is fully depressed, a lock mechanism inside the piezoelectric mechanism 4 is released and the hammer strongly hits the piezoelectric element by way of a hitting plate. Then, discharge voltage (high voltage pulse) is generated to cause spark between the discharge electrode at the tip of the discharge electrode 17 and the nozzle tip 11 at the end of the nozzle 3 acting as another discharge electrode connected to the lever pusher 18, thereby igniting fuel gas.

The ignition operation by depressing the actuation cap 6 is made by overcoming the resistance of the return spring inside the piezoelectric mechanism 4. At the initial ignition stage, the actuation load is the spring load of the return spring. However, when the actuation cap 6 is depressed to e.g., 3.4 mm, the torsion plates 7,7 engage the upper end surface 1*a* of the lighter body 1. In the subsequent stroke, the torsion plates 7,7 distort as illustrated in FIG. 5, thereby adding the resilient load of the torsion plates 7,7 to the spring load of the return spring as the resistance to the depressing operation. This means that the actuation load is increased.

Figure 6:
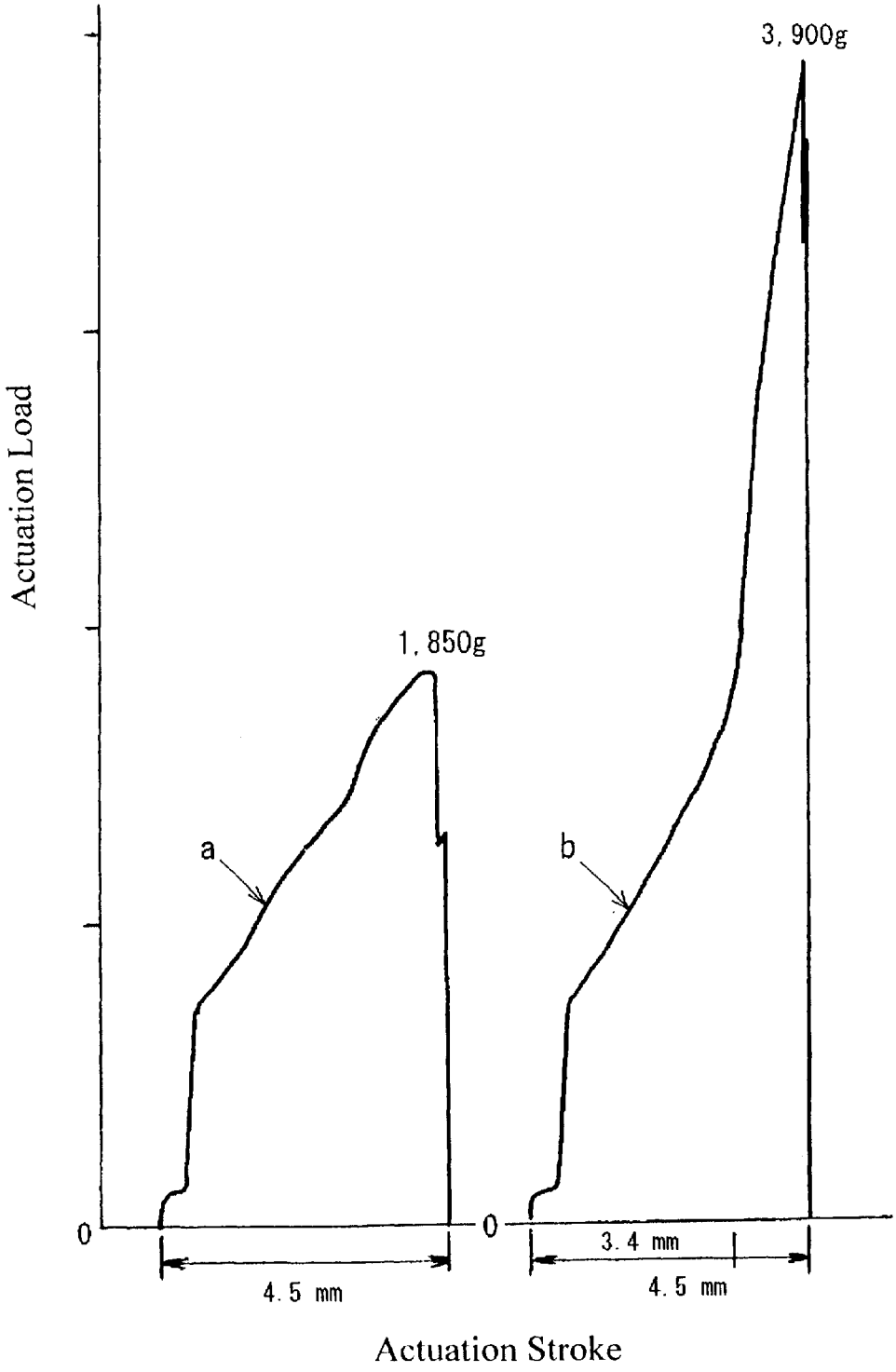
FIG. 6 is a graph showing the relationship between actuation stroke and actuation load along with a reference example.

In this case, the relationship between the actuation stroke (that is equal to the actuation stroke leading to generation of discharge voltage by depressing the piezoelectric mechanism 4 in this particular example) of the actuation cap 6 and the actuation load is for example as shown by the graph b in FIG. 6. When the actuation cap 6 is depressed to the point (e.g., 3.4 mm) where the torsion plates 7,7 engage the upper end surface of the lighter body 1, the actuation load sharply increases to reach about 40N (3,900 grams) immediately before ignition. The graph a in FIG. 6 is the actuation load excluding the torsion plates 7,7. In this case, the spring load inside the piezoelectric mechanism is the actuation load over the entire actuation stroke. The maximum actuation load is e.g., 19N (1,850 grams)

In this manner, the actuation load of the actuation cap 6 sharply increases in the way of the actuation stroke (the actuation stroke of the piezoelectric mechanism 4) to reach the final actuation load of about 40N that is too heavy to operate by children. Also, the point of sharply increasing the actuation load is after reaching the 40%~10% of the actuation stroke prior to generation of discharge voltage. This means that the actuation load is light in the initial actuation stage, thereby maintaining excellent operability to normal users.

Preferably, the maximum actuation load is chosen to the 30N~50N range in consideration of safety and operability.

It is also possible to separate the torsion plates 7,7 from the actuation cap 6. The material of the torsion plates 7,7 is not limited to polyacetal and may be other synthetic resin having excellent durability and suitable for repeated use. The torsion plates 7,7 may be metal spring.

Although the above embodiment is directed to the piezoelectric ignition lighter having vertically movable actuation cap, the present invention can be applied to the piezoelectric ignition lighter having a slidable actuation cap.

INDUSTRIAL APPLICABILITY

The piezoelectric ignition lighter according to the present invention features in sharply increasing the actuation load in the way of the actuation stroke of the piezoelectric mechanism. As a result, the actuation load is light at the initial ignition stage and becomes heavy in the way of actuation stroke, thereby disabling children or the like to use the lighter but avoiding to degrade operability to normal users. This helps to maintain safety and excellent operability and also improve market value.

Also, there is no restriction in construction because of the use of the resilient member such as torsion plates to be disposed in a limited space near the piezoelectric mechanism. In case of torsion plates, they can be integrally formed with the actuation cap to eliminate restriction in construction and to reduce production cost.

What is claimed is:

1. An ignition actuation mechanism for a piezoelectric ignition lighter, comprising:

a lighter body, an actuation member adapted to be moved through an actuation stroke, said actuation member having a load to resist actuation;

a piezoelectric mechanism having a spring load and adapted to be depressed by actuation of said actuation member in one direction to generate discharge voltage and to spark between discharge electrodes for igniting a fuel gas, wherein the load to resist actuation of the actuation member is a sharply increased value during an actuation stroke up to a point of generating a discharge voltage by depressing of the piezoelectric mechanism, wherein a resilient member having a resilient load is disposed between the actuation member and the lighter body, said resilient member adapted to be resiliently compressed during the actuation stroke of the piezoelectric mechanism, wherein the spring load of the piezoelectric mechanism acts as resistance to the actuation member at an initial stage of the actuation stroke of the piezoelectric unit, wherein the resilient load of the resilient member is made to act as a resistance to actuation of the actuation member in addition to the spring load of the piezoelectric mechanism during the actuation stroke, wherein the resilient member comprises at least one torsion plate integral with the actuation member.

2. The lighter of claim 1, wherein the actuation member and the at least one torsion plate are integrally molded of polyacetal resin.

3. A piezoelectric ignition lighter, comprising:

a piezoelectric mechanism for generating a discharge voltage in response to being activated; and an actuation member being in slidable relation with the piezoelectric mechanism to perform an activation stroke that includes (i) an initial stage having an associated initial load resistance and (ii) a subsequent actuation stage that results wit the piezoelectric mechanism being activated, the actuation stage having an additional load resistance sufficiently greater than the initial stage load resistance to inhibit a class of users from being able to complete the actuation stage, the actuation member including at least one elastic torsion member to provide the additional load resistance during the actuation stage, further comprising a lighter body having a surface that is configured to engage the at least one elastic member in the actuation stage of the actuation stroke, the at least one elastic torsion member being disposed between the actuation member and the lighter body surface, the piezoelectric mechanism having a return spring to provide the initial load resistance to the actuation member in the initial stage, wherein the load resistance provided by the at least one elastic torsion member is in addition to that provided by the return spring during the actuation stage, wherein the lighter body surface is configured to engage the at least one elastic torsion member so that the actuation stage occurs at a desired distance after the beginning of the initial stage, and wherein the at least one elastic member comprises first and second spaced-apart torsion plate member having flat surfaces for engaging the lighter body surface.

* * * * *